United States Patent [19]

Childress

[11] 4,022,026

[45] May 10, 1977

[54] SAFETY SHIELD ATTACHMENT

[76] Inventor: Ray Childress, P.O. Box 853, Richlands, Va. 24641

[22] Filed: June 10, 1976

[21] Appl. No.: 694,714

[52] U.S. Cl. ..... 61/63; 61/45 R; 173/23; 175/219; 182/112

[51] Int. Cl.[2] ..... E21D 19/00

[58] Field of Search ..... 173/23, 22, 52, 38; 61/45 D, 63; 182/112; 175/219, 213; 299/10, 11, 33; 280/150 F, 150 R, 150.5, 156

[56] References Cited

UNITED STATES PATENTS

| | | | |
|---|---|---|---|
| 3,737,006 | 6/1973 | Long | 182/112 |
| 3,784,159 | 1/1974 | Skattman et al. | 173/23 X |
| 3,865,197 | 2/1975 | McCormick | 173/23 |
| 3,937,517 | 2/1976 | Donovan et al. | 175/219X |

FOREIGN PATENTS OR APPLICATIONS

| | | | |
|---|---|---|---|
| 826,897 | 1/1952 | Germany | 173/23 |

*Primary Examiner*—Dennis L. Taylor

[57] ABSTRACT

A safety shield attachment for protecting machine operators from debris or cave-ins from above has a canopy which is pivotally supported at one end, but normally retained in a fixed position over an operator's station, and a platform pivotally supported at one end, the other end of which can be suspended from the canopy at a fixed level therebelow or allowed to rest upon the ground in a "free-floating" condition.

7 Claims, 7 Drawing Figures

SAFETY SHIELD ATTACHMENT

FIELD OF INVENTION

Fire Escapes, Ladders, Scaffolds, Safety Device, Platform Associated.

PRIOR ART

U.S. Pat. Nos. to Ryskamp, 3,259,211; to Goodacre, 3,268,033; to Brondner, 3,283,831; to Weisker, 3,638,758; to Long, 3,737,006 and 3,768,574; to McCormick, 3,865,197 and 3,893,520; and to Donavan, 3,937,517.

BACKGROUND

Machine operator's elevatable platforms which are pivotally supported at one end to a machine are known (Brondner, supra) as also are pivotally supported overhead canopies (Weisker and Ryskamp, supra). With the advent of mine safety requirements, the concept of utilizing both a pivoted canopy and a pivoted platform above and below a machine operator's station have been applied to machines, the operators of which must be protected from overhead debris and cave-ins (for example, Long, supra). In these applications, where the forces of dislodged rocks or falling roof can be tremendous, extreme strength and versatility are essential to assure protection of the operator.

OBJECTS

The object of this invention is to provide a safety shield attachment readily applicable to a number of different machines, such as mine roof drilling, bolting and plating machines, wherein a platform having thereon a control station is pivoted at one end to a mounting assembly (by which it is attached to the machine), and wherein a canopy above the control station is also attached to the mounting assembly, and wherein the free ends of the canopy and platform are connected by a pair of hydraulic jacks. Means for adjusting the height and angle of the attached end of the canopy according to the minimum roof height of the environment of the machine's operation are provided, and once this is done, the canopy is normally maintained in its adjusted position by strong diagonal mechanical bracing. By means of the hydraulic jacks, the free end of the platform may be suspended from the free end of the canopy in an elevated position (as is its usual position when the machine is being moved for comparatively long distances), or it can be left free to rest upon the ground, i.e., in its "free floating" condition, when the machine is stationary or being moved for short distances. When the free end of the platform is at rest upon the ground, the hydraulic jacks can serve as rigid braces extending directly from the ground through the platform to the free end of the canopy. In this condition, the structure is a rigid box, with one corner mechanically braced by a rigid diagonal. Thus, the machine operator is protected from the mine roof itself, and also protected against closure together of the canopy and the platform, like jaws, with him in between.

These and other objects will be apparent from the following specification and drawings, inc which:

Figures 1, 2:
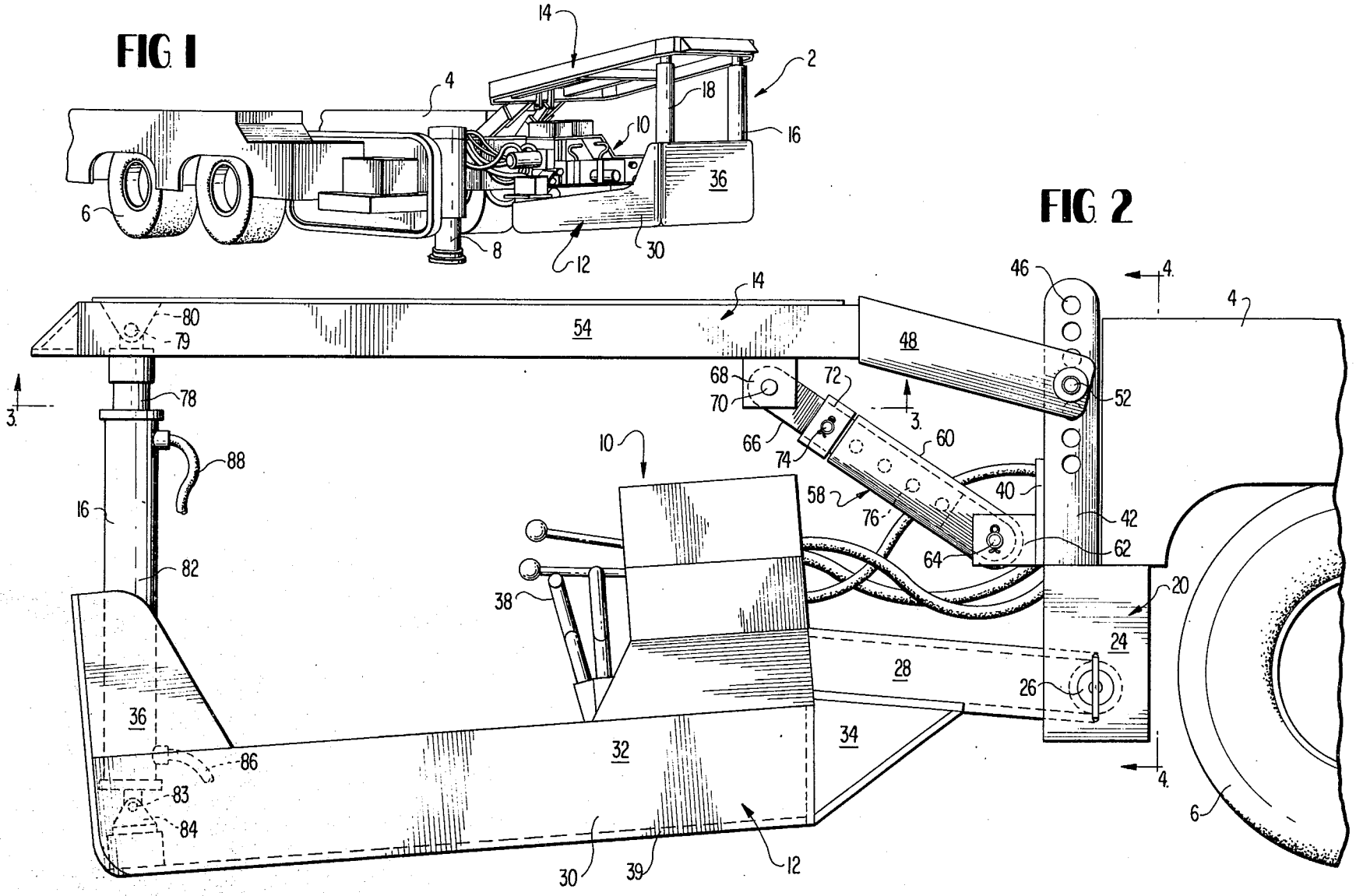
FIG. 1 is a perspective view showing the safety shield attachment in a typical application on one end of a mine roof drilling and bolting machine, and with the platform in suspended condition.
FIG. 2 is a side elevation of the attachment in free floating condition.

Referring now to the drawings, in which like reference numerals denote similar elements, the safety shield attachment 2 which consitutes the subject invention is shown in FIG. 1 in typical usage, wherein it is mounted on the front end of a mine rool drilling and bolting machine 4 which moves about over the ground on wheels 6 and has at one side of the front end thereof auger driving apparatus 8. It will be understood that the machine 4 contains the usual complement of motors, transmissions and the like, all of which are controlled by an operator at a control station 10 mounted on a platform 12 alongside the auger driving apparatus, where he can see it. The platform 12 and a canopy 14 thereover are pivoted at their inner ends and outer free ends have connected therebetween hydraulic jacks 16 and 18. In the condition shown in FIG. 1, platform 12 is in its suspended position wherein the free end is supported above the ground by means of fluid trapped in hydraulic jacks 16 and 18, as detailed hereinafter.

Figure 3:
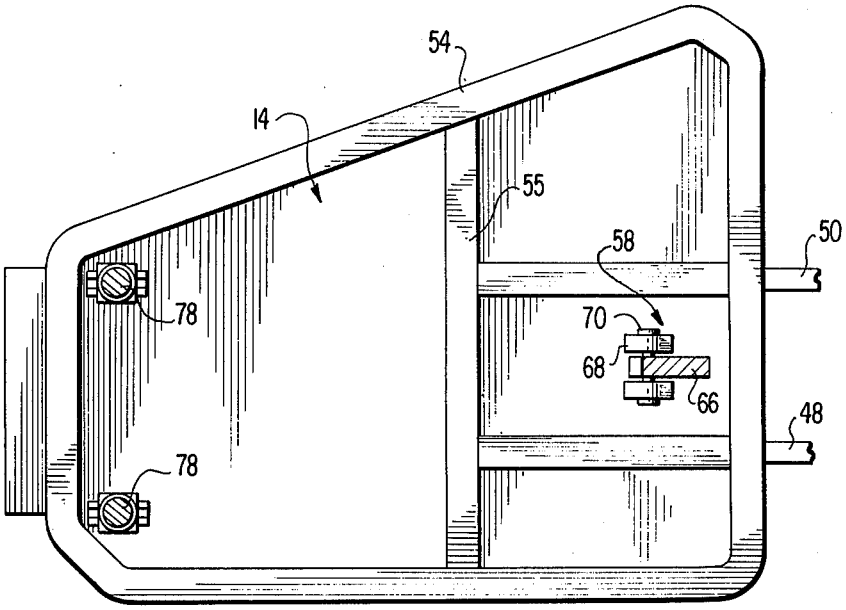
FIG. 3 is a plan view of the canopy with its cover sheet removed.
Figure 4:
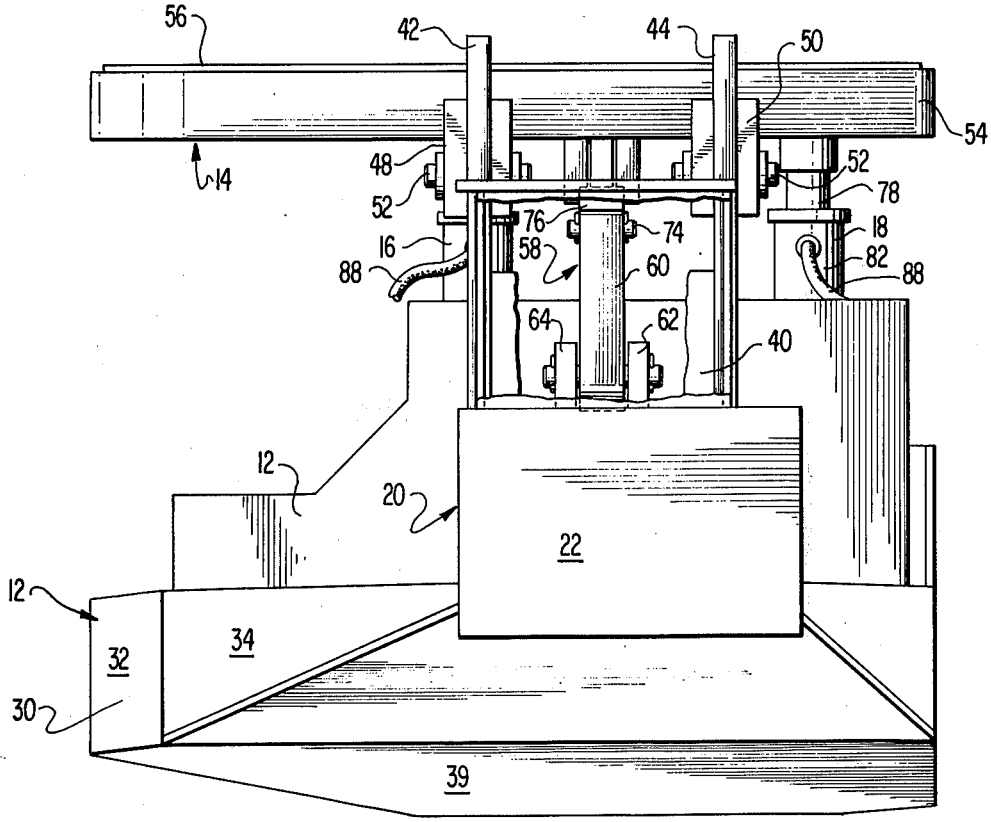
FIG. 4 is an elevation view of the assembly, taken along the line 4—4 of FIG. 1.

Referring more particularly to FIGS. 2, 3 and 4, the safety shield attachment 2 comprises a mounting channel 20 which is rigidly secured as by welding to the frame of machine 4, channel 20 consisting of a plate 22 with integral flanges 24 at its opposite ends. A pivot shaft 26 rotatably mounted in flanges 24 has affixed thereto a pair of arms 28 to which the floor box 30 is connected. The floor box consists of side walls 32 and apron 34, and an upwardly extended end wall 36 which serves as a shield. Appropriate machine and platform operation controls 38 at the control station 10 are manipulated by an operator seated on or lying upon the floor 39 of the platform 12.

Canopy 14 is supported from mounting channel 20 by a plate 40 and two upwardly extending posts 42 and 44, all integrally connected to mounting channel 20. Posts 42 and 44 each have a series of pivot holes 46 to which canopy arms 48 and 50 are adjustably connected by pivots 52. The frame 54 of canopy 14 has cross bracing 55 and a cover plate 56, the canopy being further supported by a diagonal brace 58 consisting of a sleeve 60 supported between ears 62 on plate 40 by a pivot pin 64, and a telescoping rod 66 connected between ears 68 on the underside of the canopy by means of a pivot pin 70. A stop collar 72 is adjustable held along the length of telescoping rod 66 by a pin 74 selectively engageable in one of a series of holes 76 along the length of rod 66. The height of the inboard end of canopy 14 can be adjusted by selecting the appropriate pivot hole 46 for the pins 52, and the maximum downward pivoting of the canopy can be predetermined by appropriate selection of one of the holes 76 through a rod 66 to be engaged by pin 74 of stop collar 72. As will be apparent by comparing FIG. 7 with FIGS. 2, 5 and 6, canopy 14 can be swung upwardly from the position in which stop collar 72 engages sleeve 60, but it cannot be swung downwardly from that position, because, when collar 72 engages sleeve 60, it becomes a rigid diagonal brace.

The rams 78 of hydraulic jacks 16 and 18 are connected to canopy 14 by pivots 79 engaged through trunions 80 on the canopy, and the cylinders 82 are connected by pivots 83 to trunions 84 on the platform. The opposite ends of cylinders 82 are connected to controlled sources of pressure and return fluid by lines 86 and 88, it being noteworthy that the control of low pressure fluid into the upper ends of cylinders 82 as controlled by solenoid controlled check valve (not shown) and the flow of fluid to or from the lower ends of cylinders 82, via lines 86 is controlled by solenoid controlled check valves, the arrangement being such that the valves controlling the flow of fluid into lines 88, when closed, prevent rams 78 from moving in either direction, and, with these valves closed as well as the valves controlling the flow of fluid in lines 86, the rams 78 cannot move in either direction and the geometry of the assembly will be fixed. However, with the valves controlling lines 86 and 88 open, and with no pressure fluid supplied, platform 12 will then be in its free floating position wherein its free end rests upon the ground.

Figure 5:
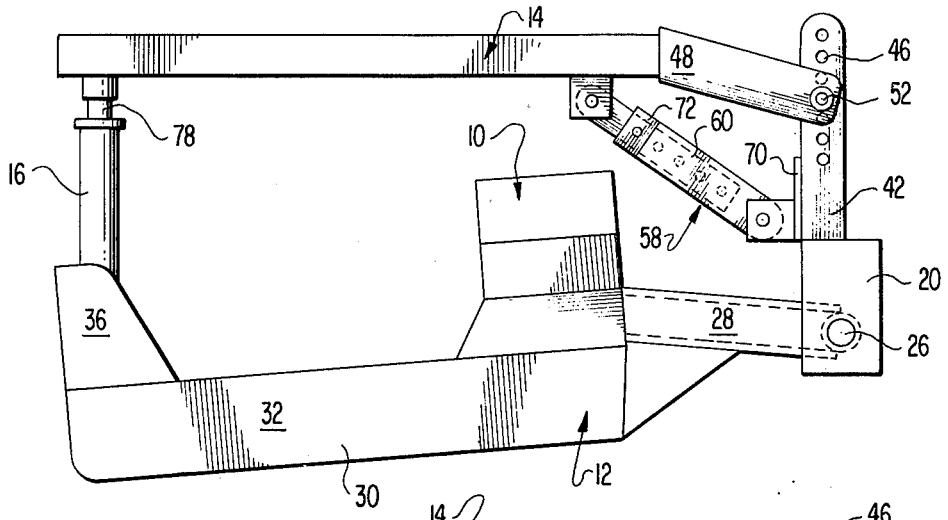
FIG. 5 is a side elevation illustrating the canopy in fixed condition and the platform in suspended position.
Figure 6:
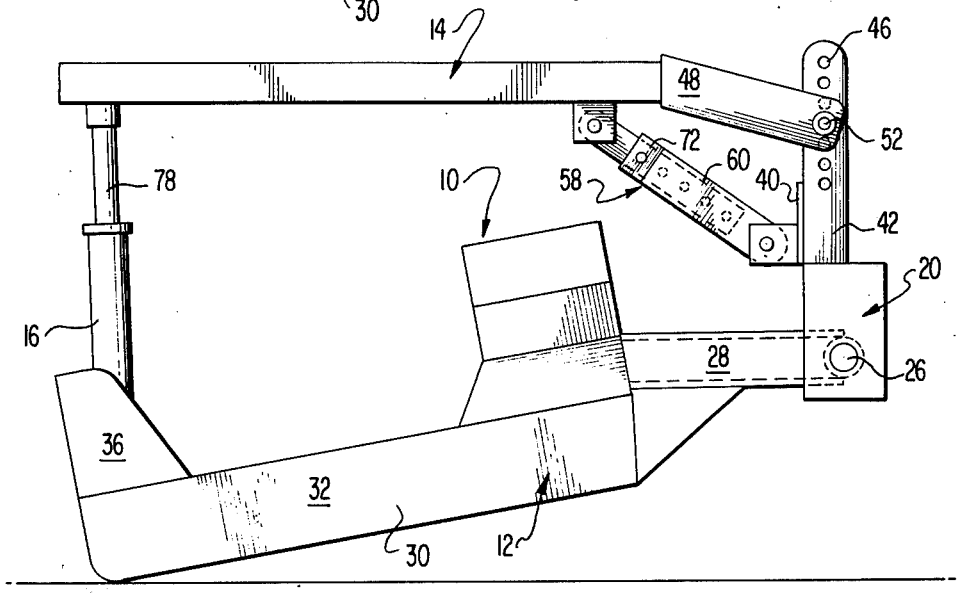
FIG. 6 is a view similar to FIG. 5, but showing the platform in free floating position with its free end at rest upon the ground; and, FIG. 7 is a view similar to FIG. 6, but showing the free end of the canopy jambed against a mine roof.
Figure 7:
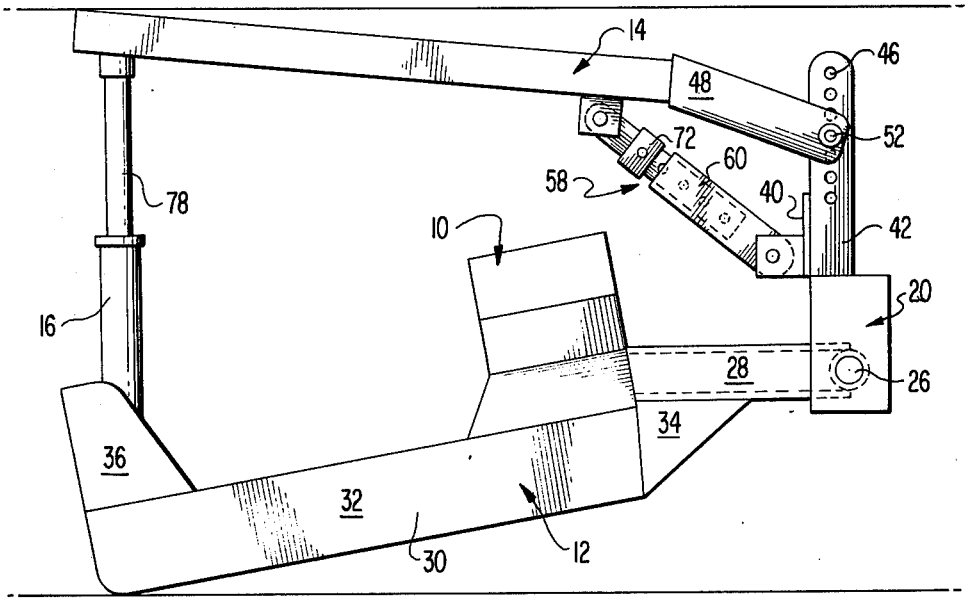

In normal operation, the height and angle of canopy 14 are adjusted by the adjustable pivot pin 52 and stop collar 72 as previously detailed. Usually the canopy 14 is disposed level, at one height or another, depending upon the approximate height of the seam in which the machine is working if it be, for example, a mine roof drilling and bolting machine used in coal mines. When the machine is to be moved to a region where it will be working, as for example, in a cut recently made by a continuous mining machine, the valves controlling lines 88 are open, fluid is withdrawn and platform 12 is swung upwardly to its elevated position (FIGS. 1 and 5). Upon reaching the location where the machine is to work, the fluid lines 86 and 88 are opened and platform 12 is in its free floating position wherein its free end rests upon the ground and follows the contours thereof as the machine moves (FIG. 6). If mine roof support is needed or if it is desired to jamb the machine in a fixed position, pressure fluid is supplied via solenoid controlled check valves in lines 86 so as to extend the rams 78 of jacks 16 and thereby force the free end of canopy 14 up against the mine roof (FIG. 7). In event the hydraulic system for jacks 16, 18 fails, when their rams 78 have telescoped inward to their maximum inward positions, they function as rigid columnar supports which prevent the free ends of platform 12 and canopy 14 from closing together, even under the weight of a collapsed mine roof, thereby protecting the operator of the machine until he can be extracted.

I claim:

1. A safety sheild attachment for protecting the operator of a machine, comprising a rigid support adapted to be connected to said machine, a platform connected by a first horizontal pivot at an inner end thereof to said support and having a free end extending outwardly therefrom, said platform being adapted to support a machine operator, a control station on said platform disposed inwardly from the free end thereof, said platform providing a support for a machine operator inwardly from the free end thereof, a canopy spaced above said platform, a second horizontal pivot connecting spaced above the first horizontal pivot and connecting an inner end of said canopy and said support, said canopy having an outer end overlying the outer end of said platform, said canopy being swingable upwardly and downwardly about said second horizontal pivot, hydraulic jack means connected between the free ends of said platform and said canopy, controlled means for serving said hydraulic jack means with pressure and return fluid and adjustable means connected between said canopy and said rigid support for selectively limiting the downward swinging of said canopy about said second horizontal pivot.

2. A safety shield as claimed in claim 1, said adjustable means comprising extensible diagonal brace means connected between the inner end of said canopy and said rigid support, said diagonal brace means having adjustable means thereon for predetermining the minimum length thereof, whereby to limit the downward pivoting of said canopy.

3. A safety shield as claimed in claim 1, and means for adjusting the vertical spacing of the second horizontal pivot means above the first horizontal pivot means.

4. A safety shield as claimed in claim 1, said controlled means for serving said hydraulic jack means with supply and return fluid including a control which permits the free end of said platform to move freely upwardly and downwardly about the pivotal connection between the inner end thereof and said rigid support means.

5. A safety shield as claimed in claim 1, said controlled means for serving said hydraulic jack means with supply and return fluid including a control which permits the free end of said platform to move freely upwardly and downwardly about the pivotal connection between the inner end thereof and said rigid support means, said adjustable means comprising extensible diagonal brace means connected between the inner end of said canopy and said rigid support, said diagonal brace means having adjustable means thereon for predetermining the minimum length thereof, whereby to limit the downward pivoting of said canopy.

6. A safety shield attachment for protecting the operator of a machine, comprising a rigid support adapted to be connected to said machine, a platform, a horizontal pivot connecting one end of said platform to said rigid support, said platform having a free end extending outwardly from said horizontal pivotal connection, a control station on said platform, said rigid support including a laterally spaced pair of upwardly-extending members rigid therewith, a canopy spaced above said platform and having an inner end, first means connecting the inner end of said canopy at a selected height along the lengths of said upwardly extending members, an extensible diagonal brace between said canopy and said upwardly-extending members, including means for limiting the downward pivotal movement of said canopy, a pair of hydraulic jacks connecting the free ends of said platform and said canopy, said platform providing a space for accommodating a machine operator inwardly from the jacks, and controlled means for serving said jack with pressure and return fluid.

7. The combination claimed in claim 6, said extensible diagonal brace including a sleeve member, a rod member slidingly engaged in said sleeve, a stop collar on said rod for engaging said sleeve, means for selectively positioning said stop collar along the length of said rod, and means for pivoting ends of said member respectively to said upwardly-extending members and said canopy.

* * * * *